US007100596B2

(12) United States Patent
Violi

(10) Patent No.: US 7,100,596 B2
(45) Date of Patent: Sep. 5, 2006

(54) FORCED CONVECTION GAS OVEN

(75) Inventor: Raymond Violi, Marlens (FR)

(73) Assignee: Societe Cooperative de Production Bourgeois, Villefranche sur Saone (FR)

( * ) Notice: Subject to any disclaimer, the term of this patent is extended or adjusted under 35 U.S.C. 154(b) by 98 days.

(21) Appl. No.: 10/485,241

(22) PCT Filed: Jul. 29, 2002

(86) PCT No.: PCT/FR02/02708

§ 371 (c)(1),
(2), (4) Date: Jan. 30, 2004

(87) PCT Pub. No.: WO03/012343

PCT Pub. Date: Feb. 13, 2003

(65) Prior Publication Data

US 2004/0187857 A1 Sep. 30, 2004

(30) Foreign Application Priority Data

Jul. 31, 2001 (FR) ..... 01 10414

(51) Int. Cl.
*A21B 1/02* (2006.01)
*F24H 15/32* (2006.01)

(52) U.S. Cl. ..... 126/21 A; 126/39 E

(58) Field of Classification Search ..... 126/21 A, 126/21 R, 19 R, 273 R, 299 E, 39 R, 39 BA, 126/39 E; 219/400, 399, 398
See application file for complete search history.

(56) References Cited

U.S. PATENT DOCUMENTS

| | | | | |
|---|---|---|---|---|
| 4,369,760 | A | 1/1983 | Jorgensen et al. | |
| 4,671,250 | A * | 6/1987 | Hurley et al. | 126/21 A |
| 5,121,737 | A * | 6/1992 | Yencha, III | 126/21 A |
| 5,497,760 | A * | 3/1996 | Alden et al. | 126/21 A |
| 5,655,511 | A * | 8/1997 | Prabhu et al. | 126/21 A |
| 6,371,104 | B1 * | 4/2002 | Voohris | 126/21 A |

FOREIGN PATENT DOCUMENTS

| | | | |
|---|---|---|---|
| EP | 0 409 685 | A1 * | 1/1991 |
| EP | 0 733 862 | A1 | 9/1996 |
| FR | 2 548 764 | A1 * | 1/1985 |

* cited by examiner

*Primary Examiner*—Josiah C. Cocks
(74) *Attorney, Agent, or Firm*—RatnerPrestia

(57) ABSTRACT

The invention concerns a forced convection gas oven wherein a globally parallelepiped muffle chamber contains a centrifugal convection turbine driven by a motor and arranged adjacent to the center of the rear peripheral wall. A gas burner is arranged coaxially upstream of the turbine, the assembly being surrounded by a mechanical protection grid. The gas burner is annular in shape and is oriented towards the center of the convection turbine. The oven is thus provided both with a better performance and a better distribution of cooking heat.

10 Claims, 5 Drawing Sheets

FORCED CONVECTION GAS OVEN

This application is a U.S. national phase application of PCT International Application No. PCT/FR02/02708 filed Jul. 29, 2002.

TECHNICAL FIELD OF THE INVENTION

The present invention relates to ovens for cooking food, and more particularly forced convection gas ovens used in institutional kitchens.

Forced convection gas ovens for cooking food generally comprise a metal muffle surrounding an interior muffle cavity, with a lower wall forming a floor, an upper wall forming a ceiling, and four vertical peripheral walls. At least one of the peripheral walls is provided with an access door for introducing food to be cooked into the interior cavity of the muffle and extracting it therefrom.

In the interior space of the oven, i.e. in the interior cavity of the muffle, convection of air is achieved by a convection turbine, that is driven in rotation by a motor, and that is generally disposed in the vicinity of one of the peripheral walls that has no access door. The turbine is mounted to rotate about a rotation axis perpendicular to the peripheral wall.

Gas burners are placed in the flow of air, upstream or downstream of the turbine, and are adapted to heat the air propelled into the muffle by the turbine, encouraging the cooking of the food.

In prior art gas ovens, for example as described in the document EP 0 733 862 A, the interior cavity of the muffle is divided into two compartments: a cooking compartment, accessible via the door, and conformed to receive the food to be cooked, and a heating compartment, containing the convection turbine and the gas burners. The cooking compartment is always isolated from the heating compartment by a separating wall, that is generally perpendicular to the rotation axis of the turbine. The separating wall has a double effect of channeling the flow of air propelled by the turbine, and protecting the heating compartment from splashed grease and other materials from the food being cooked. In fact, in prior art ovens, a constant concern is preventing splashes from food being cooked soiling the members inside the heating compartment, namely the turbine, the gas burners and sensors used to control these elements.

Despite the presence of the separating wall, manual cleaning operations are periodically required to guarantee that the oven is clean. Cleaning cannot be automated in the prior art oven structures, and necessitates demounting and remounting the separating wall.

Another problem that is encountered in gas ovens of this kind for cooking food is the difficulty of ensuring regular cooking of all the food in the oven, regardless of its position within the cooking compartment. It is found in fact that the cooking of the food can vary significantly as a function of the position of the food in the cooking compartment. Some areas of the cooking compartment can overheat the food, while other areas achieve insufficient heating. Also, the evenness of cooking is modified as a function of the type of food to be cooked, and as a function of the quantities of food introduced into the cooking compartment. This results in uneven cooking, and reduced efficiency.

SUMMARY OF THE INVENTION

A particular object of the present invention is to avoid the drawbacks of prior art structures of forced convection gas ovens for cooking food, with the aim of achieving more even cooking and improved efficiency.

The invention stems from the surprising observation that a particular disposition of the gas burner achieves more even cooking and improved efficiency.

Accordingly, to achieve the above and other objects, the invention proposes a forced convection gas oven for cooking food, the oven comprising:

- a muffle with a generally parallelepipedal interior cavity delimited by a lower floor wall, an upper ceiling wall and four peripheral walls, at least one of the peripheral walls being provided with an access door for entry of food to be cooked into the interior cavity of the muffle and its exit therefrom,
- a centrifugal convection turbine, driven in rotation by a motor, disposed in the interior cavity of the muffle in the vicinity of the center of an adjacent peripheral wall with no access door, mounted to rotate about a rotation axis perpendicular to the adjacent peripheral wall, and adapted to aspirate air axially toward the center of the adjacent peripheral wall and to discharge it radially toward the edges of the adjacent peripheral wall,
- a gas burner placed axially in the aspiration inlet of the convection turbine, and adapted to heat the air that is propelled into the muffle by the convection turbine to cook the food,
- a cooking volume, reserved in the interior cavity of the muffle to receive food to be cooked;

according to the invention, the gas burner is directed toward said peripheral wall of the oven, at which wall the convection turbine is adjacent, and the gas burner is directed toward the center of the convection turbine.

The turbine can advantageously have a generally cylindrical structure, with a posterior flange carrying a plurality of short blades at the front and distributed around its periphery.

The diameter of the convection turbine can advantageously be greater than one third of the larger dimension of the adjacent peripheral wall.

In one advantageous embodiment, the gas burner is generally annular, and its axis is substantially horizontal and perpendicular to said adjacent peripheral wall.

For example, the gas burner comprises a posterior heating plate, with holes through which gas can flow distributed over its surface, and shutting off an annular cavity in a burner body.

A burned gas evacuation pipe, through which the burned gases escape axially away from the adjacent peripheral wall and are then guided toward the upper portion of the oven, advantageously passes through the central passage of the gas burner.

BRIEF DESCRIPTION OF THE DRAWINGS

Other objects, features and advantages of the present invention will emerge from the following description of particular embodiments of the invention, which is given with reference to the appended drawings, in which.

DESCRIPTION OF THE PREFERRED EMBODIMENTS

Figure 1:
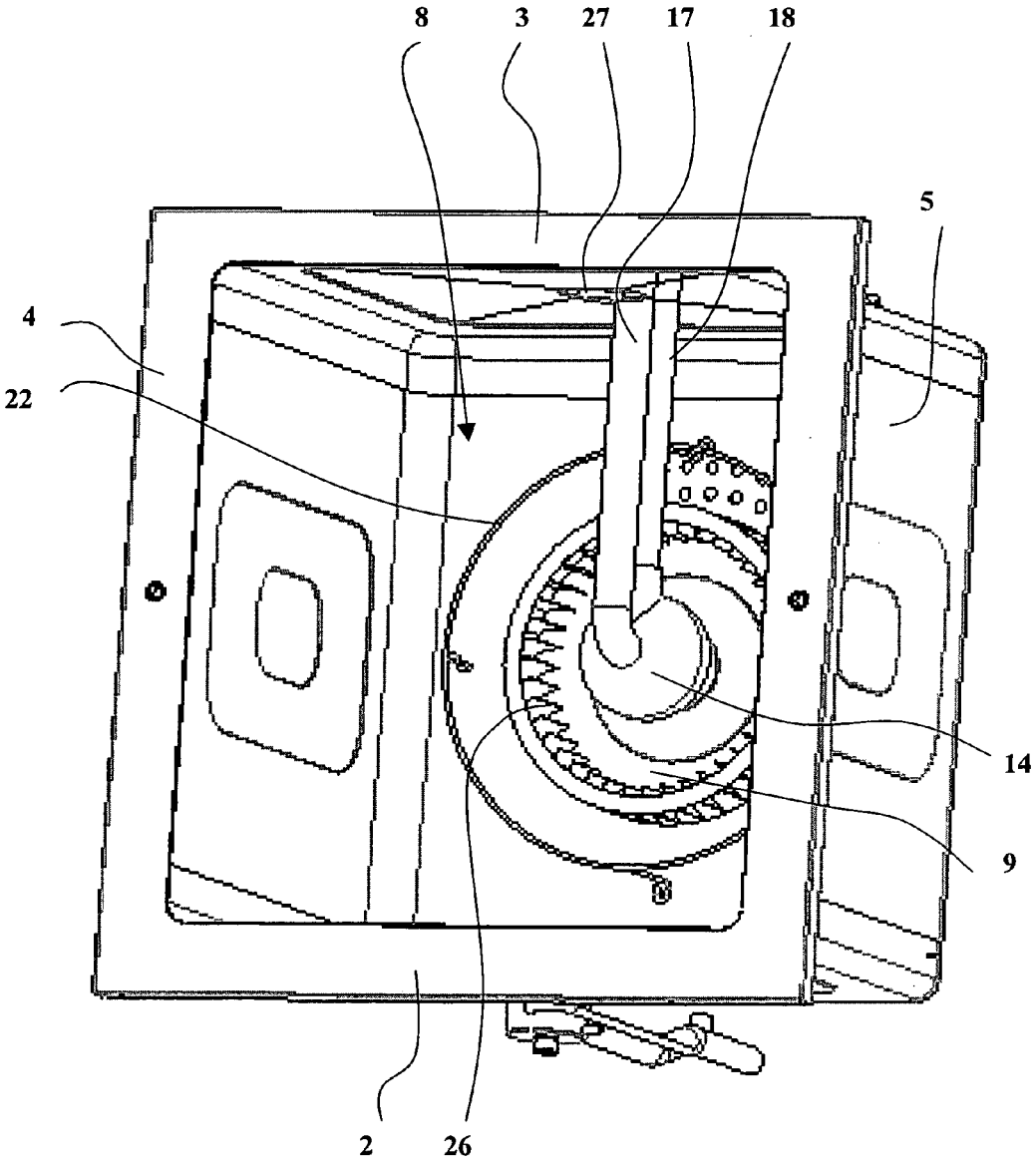
FIG. 1 is a perspective view of one embodiment of an oven according to the invention.

In the embodiment depicted in the figures, a convection oven according to the invention comprises a muffle 1, having an interior cavity 8 of generally parallelepipedal shape delimited by a bottom floor wall 2, a top ceiling wall 3, two opposite lateral peripheral walls 4 and 5, an anterior peripheral wall 6 and a posterior peripheral wall 7.

The anterior peripheral wall 6 is fitted with an access door for introducing food to be cooked into the interior cavity 8 of the muffle and extracting it therefrom.

The interior faces of the walls of the muffle are generally smooth, to prevent sticking and retention of food particles liable to be separated from food to be cooked.

A convection turbine 9 is driven in rotation by a motor 10 supplied with power by an external electrical power supply. The convection turbine 9 is of the centrifugal type, aspirating air axially via its center and discharging air radially via its periphery. To this end it comprises inclined blades, in the usual manner known in the art. The convection turbine 9 is disposed in the vicinity of the center of a peripheral wall with no access door. In the embodiment shown, the convection turbine 9 is disposed in the vicinity of the center of the posterior peripheral wall 7 of the muffle.

Alternatively, in an embodiment that is not depicted in the figures, an oven can be provided to have two opposite doors respectively formed in the anterior peripheral wall 6 and in the posterior peripheral wall 7, with the turbine placed in the vicinity of one of the opposite lateral peripheral walls 4 and 5 of the oven.

The convection turbine 9 is mounted to rotate about a rotation axis 11 perpendicular to the posterior peripheral wall 7 to which it is adjacent.

Accordingly, the convection turbine 9 aspirates air axially toward the center of the posterior peripheral wall 7 and discharges air radially toward the edges of the posterior peripheral wall 7.

According to the invention, the heating means comprise a gas burner 14, placed axially in the aspiration inlet of the convection turbine 9, and adapted to heat the air that is propelled into the muffle by the convection turbine 9. The gas burner 14 is directed toward the posterior wall 7 of the oven, i.e. directs the flame that it produces toward the posterior wall 7 of the oven. Simultaneously, the gas burner 14 is directed toward the center of the turbine 9, i.e. directs the flame that it produces toward the center of the turbine 9. It is supplied via a supply pipe 16. A pipe 17 for evacuating burned gases passes through its central portion.

Figure 4:
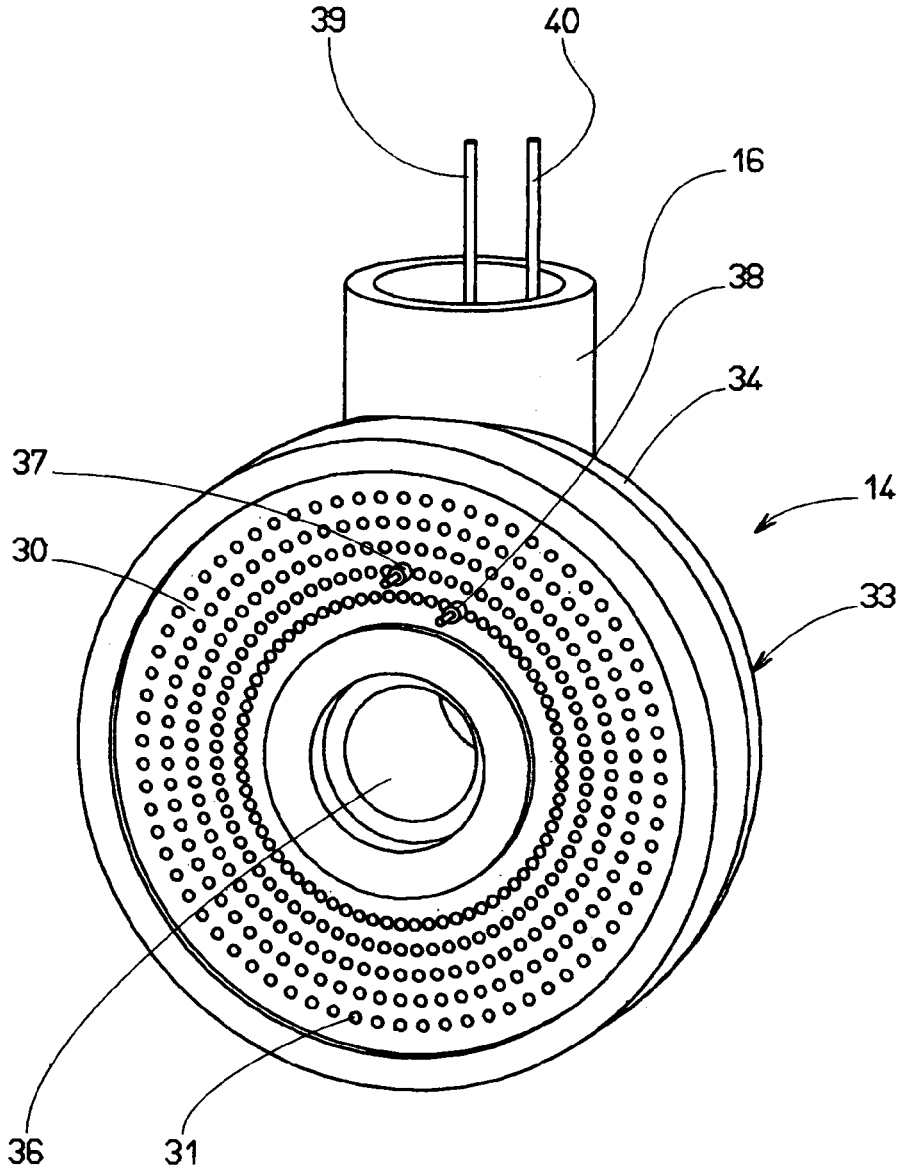
FIG. 4 is a perspective view of one embodiment of the gas burner according to the invention.
Figure 5:
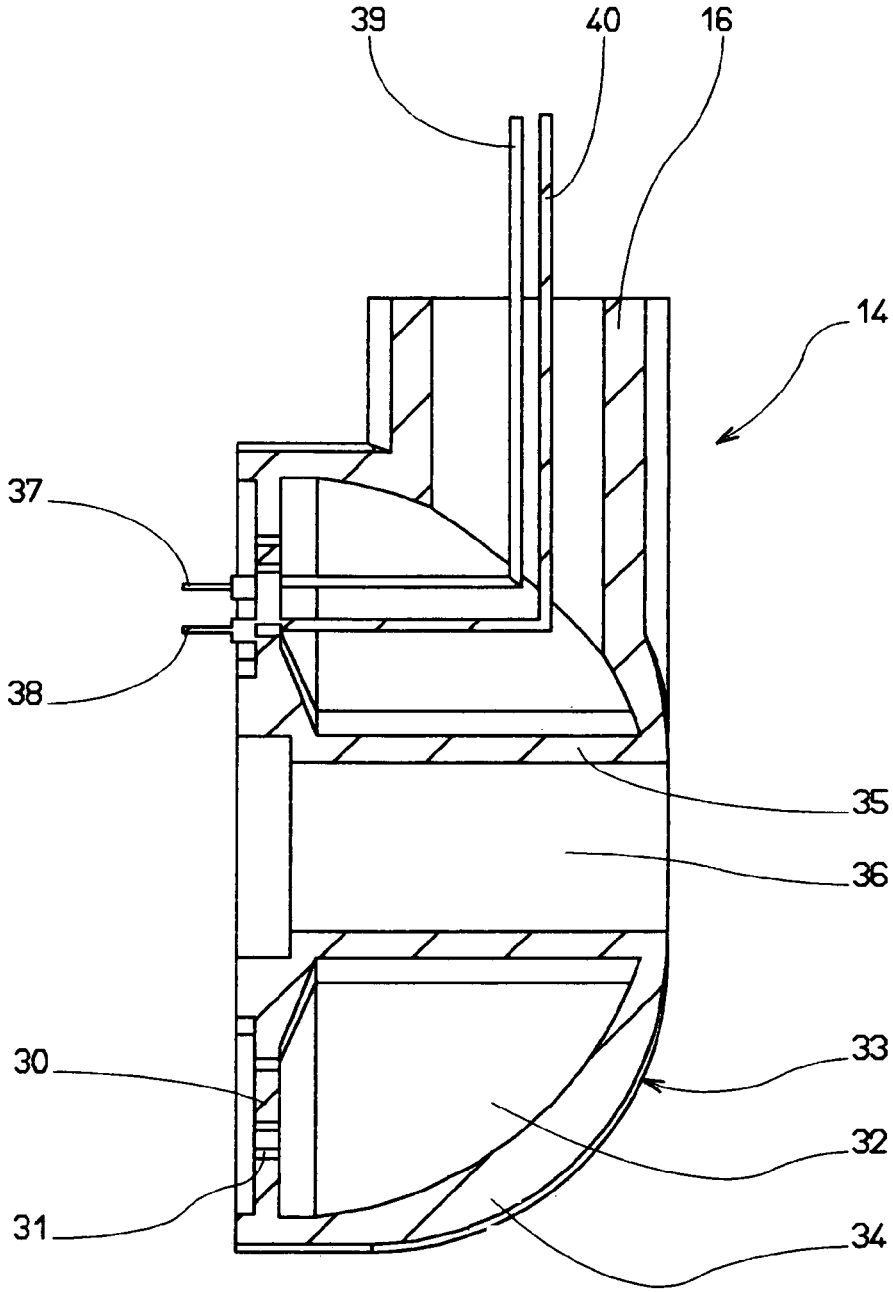
FIG. 5 is a side view in diametral section of the FIG. 4 gas burner.

FIGS. 4 and 5 depict a preferred embodiment of the gas burner 14 according to the invention.

The generally annular gas burner 14 comprises a posterior heating plate 30, with holes through which gas can flow, such as the hole 31, distributed over its surface. As shown in FIG. 4, for example, approximately 60 to 80 radial rows of five holes can be provided and be formed in a posterior heating plate 30 that is relatively thick and in which the length of the holes 31 through which gas can flow exceeds their diameter.

The posterior heating plate 30 closes off an annular cavity 32 of a burner body 33 delimited by a hemispherical peripheral wall 34 and by a coaxial tubular central wall 35. The tubular central wall 35 defines a crossing central passage 36, through which passes the pipe 17 for evacuating burned gases which is not shown in FIGS. 4 and 5 but has already been referred to with reference to FIGS. 1 to 3.

The posterior heating plate 30 comprises at least one ignition electrode 37 and one flame control electrode 38.

The annular cavity 32 of the burner body 33 communicates with the supply pipe 16, part of which is depicted in FIGS. 4 and 5.

The electrodes 37 and 38 are advantageously connected to a control device, not shown, by respective connecting lines 39 and 40 disposed inside the supply pipe 16.

Figure 2:
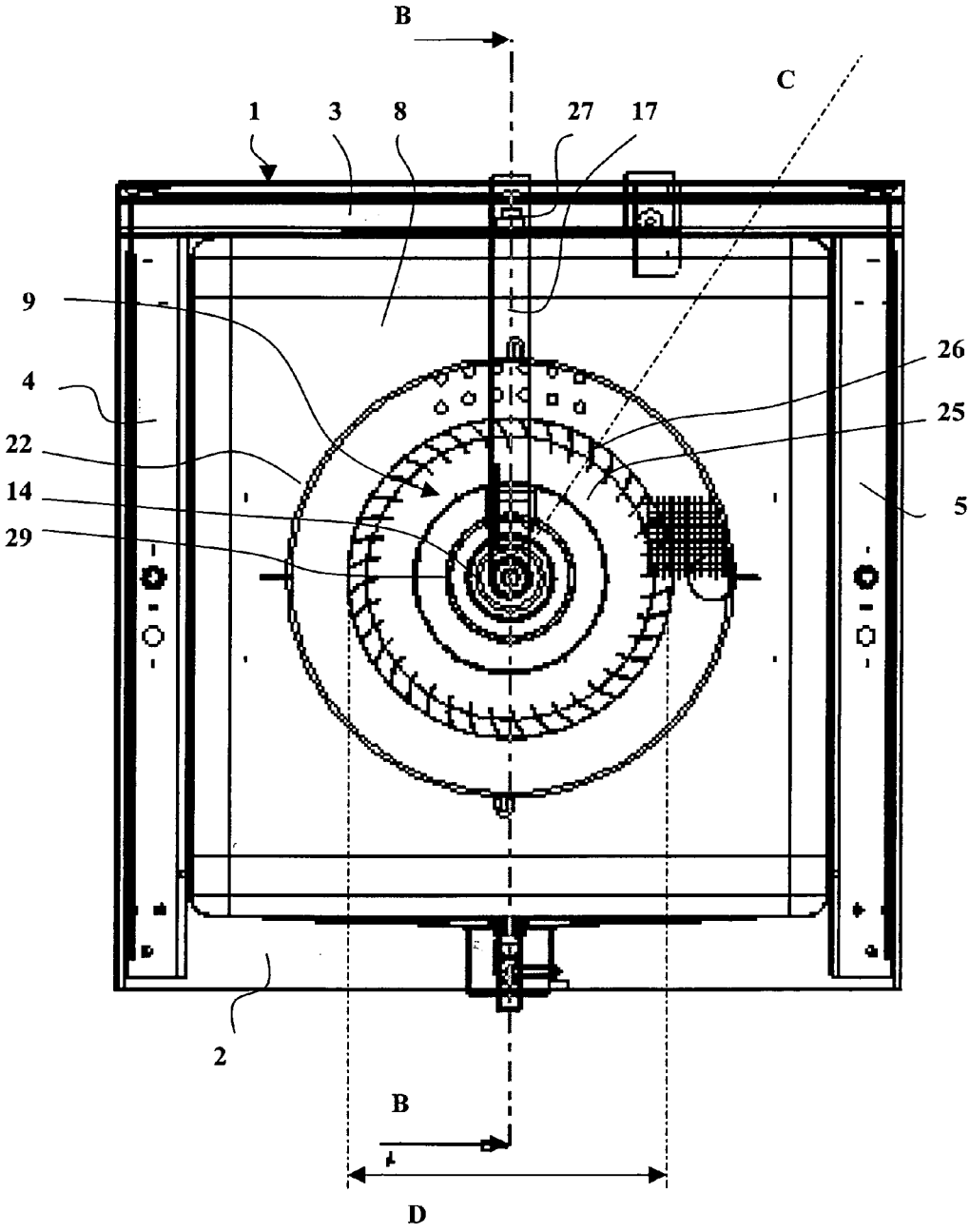
FIG. 2 is a front view of the FIG. 1 oven.
Figure 3:
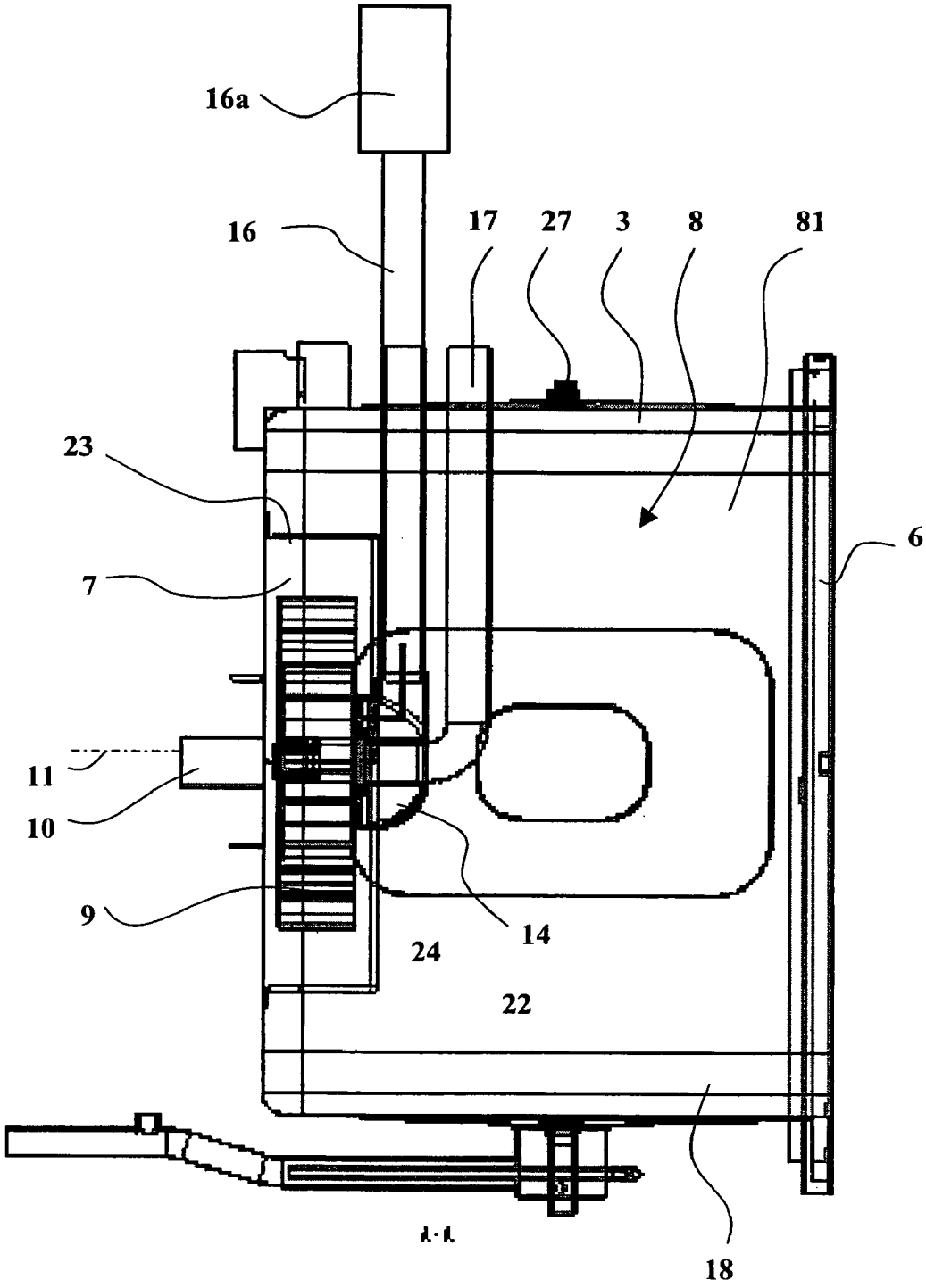
FIG. 3 is a side view of the FIG. 2 oven, in section taken along the line B—B in FIG. 2.

As can be seen in FIGS. 1 to 3, the annular gas burner 14 is oriented with its axis substantially horizontal and perpendicular to the adjacent peripheral wall 7 or back wall of the oven. The pipe 17 for evacuating burned gases therefore has a first section passing coaxially through the central passage 36 of the gas burner 14, so that the burned gases exhaust axially away from the adjacent peripheral wall 7 and are then guided toward the upper portion of the oven in the burned gases evacuation pipe 17.

Means for receiving the food to be cooked are also provided inside the muffle 1. In the embodiment depicted in the figures, a cooking volume 81 is reserved inside the interior cavity 8 of the muffle to receive food to be cooked, and a simple frame is provided to support removable shelves, adapted to enter the muffle through the door provided in the anterior peripheral wall 6. The shelf support frame comprises uprights connected by top crossmembers to constitute an open and generally parallelepipedal structure allowing free circulation of air inside the oven. The shelf support frame structure carries lateral slideways, for example in the form of U-shaped profiles, perpendicular to the anterior peripheral wall 6, and conformed to receive in a sliding fashion and to support the lateral edges of horizontal shelves on which food to be cooked can be placed.

The convection turbine 9 and the gas burner 14 are placed in the muffle 1 in direct communication with the cooking volume 81, with no separating wall opposing the flow of air. There is merely provided a mechanical protection grid 22, which is conformed and interposed between the cooking volume 81 and the combination of the convection turbine 9 and the gas burner 14, to prevent mechanical contact of a user's hand with the blades of the rotating turbine or with the gas burner 14. Thus, the mechanical protection grid 22 is placed on the upstream side of the gas burner 14. The mechanical protection grid 22 is of closed and enveloping cylindrical shape, with a cylindrical peripheral portion 23 and a plane front portion 24. The mechanical protection grid 22 has mesh size that is sufficiently large not to impede the flow of air toward or away from the convection turbine 9, and sufficiently small for a user's fingers not to pass through them and to encourage the distribution of the convection air flow around the gas burner 14.

In the embodiment shown, the central region of the front portion 24 of the mechanical protection grid 22 carries a filter 29 or a grid of finer mesh, encouraging a more regular flow of convection air around the gas burner 14 to stabilize the flame.

Clearly, in the oven structure as defined above, the air discharged radially by the convection turbine 9 is guided only by the peripheral walls of the muffle 1, and is distributed more freely throughout the cooking volume 81. This achieves more even cooking.

Simultaneously, there is nothing to oppose the free movement of splashed food particles that come from the food to be cooked in the cooking volume 81 and that can propagate into the whole of the interior cavity 8 of the muffle 1, and especially toward the convection turbine 9 and the gas burner 14. However, the free flow of air produces an effect of self-cleaning of the oven, and the particles do not remain in the area occupied by the convection turbine 9 and the gas burner 14.

To assure good convection of air, a convection turbine 9 with a generally cylindrical structure can advantageously be used, with a posterior flange 25 in the shape of a disc carrying a plurality of short blades 26 at the front and distributed around its periphery. The diameter D of the convection turbine 9 is preferably more than one third of the larger dimension (width or height) of the adjacent posterior peripheral wall 7.

In the embodiment depicted, the convection turbine 9 has at least twelve blades 26 at the front that have a radial dimension less than one tenth of its diameter D.

The embodiment depicted further comprises a cleaning device 27 that sprays water into the muffle 1.

The cleaning device 27 can comprise a horizontal cup adjacent the center of the upper ceiling wall 3, with central water supply means to produce a flow of water toward the periphery of the cup, parallel to the upper ceiling wall 3. The water is sprayed radially at the periphery of the cup, preferably when the oven is still relatively warm, and the water then flows over all of the peripheral walls of the oven as well as over the convection turbine 9 and the heating means.

The means according to the invention assure correct cooking not only by simple convection of hot gas, but also mixed cooking in the presence of steam.

The invention can provide better control of combustion by supplying the gas burner 14 with an appropriate mixture of gas and air at a particular pressure. To this end, a device for producing blown air 16*a* (FIG. 3) is connected into the supply circuit 16 of the gas burner 14, on the upstream side, to supply the gas burner 14 with blown air. The power of the device for producing blown air 16*a* is advantageously adjustable.

The present invention is not limited to the embodiments that have been described explicitly, but includes variants and generalizations thereof within the scope of the following claims.

The invention claimed is:

1. Forced convection gas oven for cooking food, the oven comprising:

a muffle with a generally parallelepiped interior cavity delimited by a lower floor wall, an upper ceiling wall and four peripheral walls, at least one of the peripheral walls being provided with an access door for entry of food to be cooked into the interior cavity of the muffle and its exit therefrom, a centrifugal convection turbine, driven in rotation by a motor, disposed in the interior cavity of the muffle in the vicinity of the center of an adjacent peripheral wall with no access door, mounted to rotate about a rotation axis perpendicular to the adjacent peripheral wall, and adapted to aspirate air axially toward the center of the adjacent peripheral wall and to discharge it radially toward the edges of the adjacent peripheral wall, a gas burner, supplied with gas via a supply pipe, placed axially in the aspiration inlet of the convection turbine, directed toward a peripheral wall of the oven and toward the center of the convection turbine, comprising a posterior heating plate, with holes through which gas can flow distributed over its surface and adapted to heat the air that is propelled into the muffle by the convection turbine to cook the food, a cooking volume, reserved in the interior cavity of the muffle to receive food to be cooked;

wherein the posterior heating plate comprises at least one ignition electrode and one flame control electrode, the electrodes are connected to a control device by respective connecting lines disposed inside the supply pipe.

2. Oven according to claim 1, wherein the convection turbine has a generally cylindrical structure, with a posterior flange carrying a plurality of short blades at the front and distributed around its periphery.

3. Oven according to claim 2, wherein the diameter of the convection turbine is greater than one third of the larger dimension of the adjacent peripheral wall.

4. Oven according to claim 1, wherein the gas burner is generally annular, and its axis is substantially horizontal and perpendicular to said adjacent peripheral wall.

5. Oven according to claim 4, wherein a burned gas evacuation pipe through which the burned gases escape axially away from the adjacent peripheral wall and are then guided toward the upper portion of the oven passes through the central passage of the gas burner.

6. Oven according to claim 1, wherein the convection turbine and the gas burner are placed in the interior cavity of the muffle in direct communication with the cooking volume, with no separating wall opposing the flow of air, and with a mechanical protection grid conformed and interposed between the convection turbine and the cooking volume to prevent contact of a user's hand with the blades of the rotating convection turbine.

7. Oven according to claim 6, wherein the mechanical protection grid is placed upstream of the gas burner, and encourages the distribution of the flow of convection air around the gas burner.

8. Oven according to claim 1, comprising a device for producing blown air, connected into the supply circuit of the gas burner on its upstream side, to supply the gas burner with blown air.

9. Oven according to claim 1 in which the ignition electrode and the flame control electrode are disposed behind the gas burner and extending outwardly only from a face of the posterior heating plate.

10. A forced convection gas oven for cooking food, the oven comprising:

a muffle with a generally parallelepipedal interior cavity delimited by a lower floor wall, an upper ceiling wall and four peripheral walls, at least one of the peripheral walls being provided with an access door for entry of food to be cooked into the interior cavity of the muffle and its exit therefrom, a centrifugal convection turbine, driven in rotation by a motor, disposed in the interior cavity of the muffle in the vicinity of the center of an adjacent peripheral wall with no access door, mounted to rotate about a rotation axis perpendicular to the adjacent peripheral wall, and adapted to aspirate air axially toward the center of the adjacent peripheral wall and to discharge it radially toward the edges of the adjacent peripheral wall, a gas burner placed axially in the aspiration inlet of the convection turbine, and adapted to heat the air that is propelled into the muffle by the convection turbine to cook the food, a cooking volume, reserved in the interior cavity of the muffle to receive food to be cooked;

wherein the gas burner is directed toward said adjacent peripheral wall of the oven, the gas burner is directed toward the center of the convection turbine the gas burner is generally annular, and its axis is substantially horizontal and perpendicular to said adjacent peripheral wall, and a burned gas evacuation pipe through which the burned gases escape axially away from the adjacent peripheral wall and are then guided toward the upper portion of the oven passing through a central passage of the gas burner.

* * * * *